US009126320B2

(12) United States Patent
Shinma et al.

(10) Patent No.: US 9,126,320 B2
(45) Date of Patent: Sep. 8, 2015

(54) POWER TOOL

(75) Inventors: Yasutoshi Shinma, Anjo (JP); Yasuhiro Kakiuchi, Anjo (JP)

(73) Assignee: MAKITA CORPORATION, Anjo-Shi (JP)

( * ) Notice: Subject to any disclaimer, the term of this patent is extended or adjusted under 35 U.S.C. 154(b) by 570 days.

(21) Appl. No.: 13/139,910

(22) PCT Filed: Dec. 8, 2009

(86) PCT No.: PCT/JP2009/070554
§ 371 (c)(1),
(2), (4) Date: Sep. 1, 2011

(87) PCT Pub. No.: WO2010/071054
PCT Pub. Date: Jun. 24, 2010

(65) Prior Publication Data

US 2011/0308828 A1 Dec. 22, 2011

(30) Foreign Application Priority Data

Dec. 19, 2008 (JP) ..... 2008-324789

(51) Int. Cl.
*B25D 9/00* (2006.01)
*B25D 17/20* (2006.01)
*B25F 5/00* (2006.01)

(52) U.S. Cl.
CPC ..... *B25D 17/20* (2013.01); *B25F 5/008* (2013.01); *B25D 2211/003* (2013.01); *B25D 2217/0061* (2013.01); *B25D 2250/121* (2013.01); *B25D 2250/245* (2013.01)

(58) Field of Classification Search
USPC ..... 173/48, 117, 122, 216, 217; 310/51; 29/598
See application file for complete search history.

(56) References Cited

U.S. PATENT DOCUMENTS 3,003,073 A * 10/1961 Bixler et al. ..... 310/59
3,511,322 A * 5/1970 Holman et al. ..... 173/75
(Continued)

FOREIGN PATENT DOCUMENTS

CN 1249225 A 4/2000
DE 196 00 339 C1 12/1996
(Continued)

OTHER PUBLICATIONS

International Preliminary Report on Patentability issued in International Patent Application No. PCT/JP2009/070554 dated Jun. 21, 2011 (with translation).
(Continued)

*Primary Examiner* — Nathaniel Chukwurah
(74) *Attorney, Agent, or Firm* — Oliff PLC

(57) ABSTRACT

A working tool in which a tip tool with a longitudinal shaft is linearly moved, wherein a motor and other tool constituting members are effectively cooled. In order to cool the inside of a motor-driven hammer comprising a main body, a motor, and a motion converter, the hammer is provided with a first cooling air passage through which a cooling air is supplied to the motor, and a second cooling air passage through which a cooling air is supplied to a hammer portion. To generate a cooling air to be supplied to the first and second cooling air passages, a cooling fan is provided at a lower portion of an output shaft of the motor and a hammer portion cooling fan is provided between the output shaft of the motor and the motion converter.

6 Claims, 13 Drawing Sheets

(56) References Cited

U.S. PATENT DOCUMENTS

| | | | | |
|---|---|---|---|---|
| 4,836,755 | A * | 6/1989 | Nitsche et al. | 417/368 |
| 6,127,751 | A | 10/2000 | Kristen et al. | |
| 6,325,157 | B1 * | 12/2001 | Arakawa et al. | 173/201 |
| 6,557,648 | B2 * | 5/2003 | Ichijyou et al. | 173/48 |
| 6,776,245 | B2 * | 8/2004 | Kristen et al. | 173/217 |
| 2004/0020671 | A1 * | 2/2004 | Lamprecht et al. | 173/217 |
| 2004/0124721 | A1 * | 7/2004 | Pfisterer et al. | 310/51 |
| 2006/0000627 | A1 * | 1/2006 | Frauhammer et al. | 173/201 |
| 2006/0137888 | A1 | 6/2006 | Soika et al. | |
| 2006/0144602 | A1 | 7/2006 | Arich et al. | |
| 2006/0144603 | A1 | 7/2006 | Arich et al. | |
| 2006/0144604 | A1 | 7/2006 | Soika et al. | |
| 2006/0156858 | A1 | 7/2006 | Soika et al. | |
| 2006/0156859 | A1 | 7/2006 | Nemetz | |
| 2008/0092363 | A1 * | 4/2008 | Faatz et al. | 29/598 |

FOREIGN PATENT DOCUMENTS

| | | |
|---|---|---|
| JP | U-50-136866 | 11/1975 |
| JP | A-11-309682 | 11/1999 |
| JP | A-2004-167639 | 6/2004 |
| JP | A-2005-193310 | 7/2005 |
| JP | A-2006-175592 | 7/2006 |

OTHER PUBLICATIONS

Aug. 5, 2013 Search Report issued in European Application No. 09833358.6.

International Search Report in International Application No. PCT/JP2009/070554; dated Apr. 6, 2010 (with English-language translation).

* cited by examiner

POWER TOOL

FIELD OF THE INVENTION

The invention relates to a power tool such as a hammer and a hammer drill in which an elongate tool bit is linearly driven.

BACKGROUND OF THE INVENTION

Japanese non-examined laid-open Patent Publication No. H11-309682 discloses a hammer drill having a motor cooling fan.

As for the hammer drill, it is desired to provide a technique for more efficiently cooling a motor and other components.

DISCLOSURE OF THE INVENTION

It is, accordingly, an object of the invention to provide an effective technique for efficiently cooling a motor and other components in a power tool in which an elongate tool bit is linearly driven.

In order to solve the above-mentioned problem, the invention provides a power tool in which an elongate tool bit is linearly driven to perform a predetermined operation. The power tool includes at least a tool body, a motor, a striking part, a motion converting part, a first cooling air passage, a second cooling air passage, a motor cooling fan and a striking part cooling fan. The "power tool" here widely includes a power tool such as a hammer and a hammer drill in which an elongate tool bit is linearly driven to perform a predetermined operation. The "predetermined operation" here suitably includes not only a hammering operation in which the tool bit performs only linear striking movement, but a hammer drill operation in which the tool bit performs linear striking movement and rotation in the circumferential direction.

The motor is housed within the tool body and disposed such that an extension of a motor output shaft extends transversely to an axis of the tool bit. The striking part is housed within a front region of the tool body and designed as an element for striking the tool bit. Therefore, the power tool is also referred to as an impact tool. The "front region of the tool body" here is defined as a region on the tool bit side or a region in the vicinity of the tool bit or a mounting part for the tool bit in the tool body. Typically, the striking part mainly includes a striking element in the form of a striker that is slidably disposed within a bore of a cylinder, and an intermediate element in the form of an impact bolt that is slidably disposed within a tool holder and transmits the kinetic energy of the striker to the tool bit. The motion converting part is disposed above the motor and serves to convert an output of rotating the motor output shaft when the motor is driven, into an output of striking the tool bit by the striking part. The motion converting part typically includes a crank mechanism which is formed by a crank shaft, a crank arm and a piston and driven by the rotating output of the motor output shaft, and a gear speed reducing mechanism which drives the crank mechanism at a reduced speed via a plurality of gears. The first cooling air passage is designed as a cooling air passage which is provided within the tool body and through which cooling air can be led to the motor. The region "above the motor" here can be defined as a region on the side of one end of the motor which is nearer to the axis of the tool bit. The second cooling air passage is designed as a cooling air passage which is provided within the tool body and through which cooling air can be led to the striking part. The motor cooling fan is disposed below the motor and activated to supply cooling air to the first cooling air passage when the motor is driven. The region "below the motor" here can be defined as a region on the side of the other end of the motor away from the axis of the tool bit. When the motor cooling fan is activated, cooling air is supplied to the first cooling air passage and cools the motor and its surrounding areas. The striking part cooling fan is disposed between the motor and the motion converting part and activated to supply cooling air to the second cooling air passage when the motor is driven. When the striking part cooling fan is activated, cooling air is supplied to the second cooling air passage and cools the striking part and its surrounding areas.

In such a construction of the power tool according to this invention, the motor cooling fan for cooling the motor and the striking part cooling fan for cooling the striking part are independent of each other. Therefore, the motor cooling fan and the striking part cooling fan can be designed to have different specifications, for example, in kind (such as an axial fan and a centrifugal fan) or in flow rate, so that optimum setting for each of the cooling fans to cool the respective areas to be cooled can be made. As a result, increase of temperature of each of the areas to be cooled can be efficiently prevented.

In the power tool according to a further embodiment of the invention, preferably, the first cooling air passage communicates with an inlet which is formed above the motor in the tool body and communicates with an outlet which is formed below the motor in the tool body. With such a construction, the first cooling air passage can be realized in which the motor is cooled by cooling air which is taken in through the inlet formed above the motor and thereafter the cooling air used for cooling the motor is discharged through the outlet formed below the motor.

In the power tool according to a further embodiment of the invention, preferably, the inlet of the first cooling air passage is fanned in a back side of the tool body on the side opposite to the tool bit. Specifically, the inlet of the first cooling air passage is located on the far side of the tool body opposite to the tool bit. With such a construction, dust which is generated during operation to be performed on the workpiece by the tool bit cannot be easily sucked in.

In the power tool according to a further embodiment of the invention, preferably, the second cooling air passage communicates with an inlet which is formed lateral to or forward of the striking part in the tool body and communicates with an outlet which is formed lateral to the motion converting part in the tool body. With such a construction, the second cooling air passage can be realized in which the striking part and the motion converting part are cooled by cooling air which is taken in through the inlet formed lateral to or forward of the striking part and thereafter the used cooling air is discharged through the outlet formed lateral to the motion converting part.

A different embodiment of the invention provides a power tool in which an elongate tool bit is linearly driven to perform a predetermined operation and which includes at least a tool body, a motor, a striking part, a motion converting part, a first cooling air passage, a second cooling air passage, a feeding brush and a single cooling fan. Of these component elements, the tool body, the motor, the striking part, the motion converting part and the first and second cooling air passages have substantially the same functions as those of the above-described power tool. The feeding brush is disposed on a lower portion of the motor and designed as a feeding brush (also referred to as a carbon brush) for feeding current to the motor. The feeding brush is held in sliding contact with an outer circumferential surface of a commutator which is disposed on a lower portion of the motor. The single cooling fan is disposed between the motor and the motion converting part on a side of the motor opposite to the feeding brush and activated to supply cooling air to both of the first and second cooling air passages when the motor is driven. Specifically, the single cooling fan serves to cool the motor by the cooling air flowing through the first cooling air passage and also to cool the striking part by the cooling air flowing through the second cooling air passage.

With such a construction of the power tool according to this invention, the motor and the motion converting part can be rationally cooled by using only the single cooling fan. Further, the cost increase can be avoided by using an existing cooling fan. Thus, an efficient cooling structure can be realized. Further, this cooling fan is disposed above the motor on the side of the motor opposite to the feeding brush so as to be located away from the feeding brush. This structure is effective in preventing entry of dust into the feeding brush of the motor which may have an adverse effect such as a so-called carbon lock.

In the power tool according to a further embodiment of the invention, preferably, the first cooling air passage communicates with an inlet which is formed below the motor in the tool body and communicates with an outlet which is formed lateral to the motion converting part in the tool body, and the second cooling air passage communicates with an inlet which is formed lateral to or forward of the striking part in the tool body and communicates with the same outlet which is also used for the first cooling air passage. With such a construction, the motor is cooled by the cooling air flowing through the first cooling air passage, and the striking part is cooled by the cooling air flowing through the second cooling air passage. Further, the cooling air used for cooling the motor and the cooling air used for cooling the striking part can be merged to cool other components of the power tool. Other components of the power tool typically include the motion converting part (the crank mechanism and the gear speed reducing mechanism) of which degree of increase of temperature is lower than that of the motor and the striking part.

A different embodiment of the invention provides a power tool in which an elongate tool bit is linearly driven to perform a predetermined operation and which includes at least a tool body, a motor, a striking part, a motion converting part, a first cooling air passage, a second cooling air passage, a single cooling fan, an inlet for the first cooling air passage, an inlet for the second cooling air passage and a single outlet. Of these component elements, the tool body, the motor, the striking part, the motion converting part and the first and second cooling air passages have substantially the same functions as those of the above-described power tool. The single cooling fan is disposed below the motor and activated to supply cooling air to both of the first and second cooling air passages when the motor is driven. The inlet for the first cooling air passage and the inlet for the second cooling air passage are both formed in a back side of the tool body on the side opposite to the tool bit in the tool body. Specifically, both of the inlets for the first and second cooling air passages are disposed on the far side of the tool body opposite to the tool bit. The single outlet is disposed below the motor in the tool body and communicates with both of the first and second cooling air passages.

With such a construction of the power tool according to this invention, the motor and the motion converting part can be rationally cooled by using only the single cooling fan. Further, the cost increase can be avoided by using an existing cooling fan. Thus, an efficient cooling structure can be realized. Further, with the construction in which the inlets for the first and second cooling air passages are both formed in the back side of the tool body in the tool body, dust which is generated during operation to be performed on the workpiece by the tool bit cannot be easily sucked in.

Preferably, the power tool according to a further embodiment of the invention further includes a first communication part, a partition wall and a plurality of second communication parts. The first communication part communicates with a housing space for the striking part and the inlet which communicates with the second cooling air passage. Thus, the outside air is taken in through the inlet and led into the housing space for the striking part via the housing space for the motion converting part. The partition wall partitions the housing space for the striking part in the axial direction of the tool bit. The second communication parts are formed in the partition wall and spaced apart from each other in the axial direction of the tool bit. Thus, when cooling air is led into the housing space for the striking part and flows through the second communication parts, the cooling air is scattered in the axial direction of the tool bit in this housing space by the partition wall. Therefore, with such a construction, the cooling air is scattered almost evenly over a wide range in the axial direction of the tool bit in the housing space for the striking part, so that the striking part can be almost evenly cooled in its entirety.

According to this invention, in a power tool in which an elongate tool bit is linearly driven, a motor and other components of the power tool can be efficiently cooled by devising a configuration and arrangement of a cooling fan and a cooling air passage. Other objects, features and advantages of the invention will be readily understood after reading the following detailed description together with the accompanying drawings and the claims.

DETAILED DESCRIPTION OF THE EMBODIMENT OF THE INVENTION

Each of the additional features and method steps disclosed above and below may be utilized separately or in conjunction with other features and method steps to provide improved power tools and devices utilized therein. Representative examples of the invention, which examples utilized many of these additional features and method steps in conjunction, will now be described in detail with reference to the drawings. This detailed description is merely intended to teach a person skilled in the art further details for practicing preferred aspects of the present teachings and is not intended to limit the scope of the invention. Only the claims define the scope of the claimed invention. Therefore, combinations of features and steps disclosed within the following detailed description may not be necessary to practice the invention in the broadest sense, and are instead taught merely to particularly describe some representative examples of the invention, which detailed description will now be given with reference to the accompanying drawings.

(First Embodiment)

An entire construction of an electric hammer 101 according to a first embodiment of the invention is now described with reference to FIGS. 1 to 3. FIG. 1 is a side view showing the entire electric hammer 101 of this embodiment. FIG. 2 shows the electric hammer 101 of FIG. 1 as viewed from a handgrip 109 side, and FIG. 3 shows a body 103 of the electric hammer 101 of FIG. 1 partly in section.

As shown in FIGS. 1 and 2, the electric hammer 101 as a representative embodiment of the "power tool" of this invention mainly includes a body 103 that forms an outer shell of the electric hammer 101, a hammer bit 119 detachably coupled to a tool holder (not shown) connected to a front (left as viewed in the drawings) end region of the body 103 in the longitudinal direction, and a handgrip 109 that is connected to the other (right as viewed in the drawings) end of the body 103 in the longitudinal direction and designed to be held by a user. The body 103 and the hammer bit 119 here are features that correspond to the "tool body" and the "tool bit", respectively, according to the invention.

The hammer bit 119 is held by the tool holder (not shown) such that it is allowed to reciprocate in its axial direction (the longitudinal direction of the body 103) with respect to the tool holder and prevented from rotating in its circumferential direction with respect to the tool holder. The hammer bit 119 may be designed either as one component of the electric hammer 101 or as a separate member from the electric hammer 101. In this specification, for the sake of convenience of explanation, in the body 103, a region on the hammer bit 119 side or a region in the vicinity of the hammer bit 119 or a mounting part for the hammer bit 119 is taken as the front or tool front region, and a region on the handgrip 109 side as the rear or tool rear region. Further, a region on the side of one end of a motor 111 which is nearer to the axis of the hammer bit 119 is taken as an upper region (above the motor), and a region on the side of the other end of the motor 111 away from the axis of the hammer bit 119 is taken as a lower region (below the motor).

The body 103 mainly includes a motor housing 105 that houses a motor 111, a motion converting part housing 107 that houses a motion converting part 113 and a striking part housing 108 that houses a striking part 115. Therefore, the electric hammer 101 having the striking part is also referred to as an impact tool.

The motion converting part housing 107 is designed as a housing part disposed above the motor housing 105. A plurality of slit-like first outlets 124 are formed in the both side walls of the motion converting part housing 107 lateral to the motion converting part 113. The first outlets 124 are features that correspond to the "outlet which is formed lateral to the motion converting part" according to this invention.

The striking part housing 108 is designed as an elongate housing part connected to the front end of the motion converting part housing 107 and extending toward the tool front region along the axis of the hammer bit 119. A plurality of slit-like first inlets 122 are formed in the both side walls of the striking part housing 108 lateral to or forward of the striking part 115. The first inlet 122 are features that correspond to the "inlet which is formed lateral to or forward of the striking part" according to this invention.

The motor housing 105 is designed as a housing part extending transversely to the extending direction of the striking part housing 108 and generally parallel to the extending direction of the handgrip 109. A plurality of slit-like second inlets 132 are formed in the back wall (rear surface) of the motor housing 105 above the motor 111, and a plurality of slit-like second outlets 134 are formed in the bottom of the motor housing 105 (below the motor 111). The second inlets 122 and the second outlets 134 are features that correspond to the "inlet which is formed above the motor" and the "outlet which is formed below the motor", respectively, according to this invention.

The handgrip 109 has a U-shape having an open front and is connected to rear ends of the motor housing 105 and the motion converting part housing 107. Further, an operating member 110 is disposed in an upper region of the handgrip 109. The operating member 110 actuates a power switch (not shown) for driving the motor 111, between on and off positions on AC power supplied via an AC cord 118.

As shown in FIG. 3, the motor 111 is disposed such that an extension of a motor output shaft 112 extends transversely to the axis of the hammer bit 119. The motion converting part 113 serves to convert a rotating output of a motor output shaft 112 of the motor 111 into linear motion and transmit it to the striking part 115.

Although not shown, the motion converting part 113 includes a crank mechanism which is formed by a crank shaft, a crank arm and a piston and driven by the rotating output of the motor output shaft 112, and a gear speed reducing mechanism which drives the crank mechanism at a reduced speed via a plurality of gears. The motion converting part 113 is a feature that corresponds to the "motion converting part" according to this invention. Although not shown, the striking part 115 mainly includes a striking element in the form of a striker that is slidably disposed within a bore of a cylinder, and an intermediate element in the form of an impact bolt that is slidably disposed within a tool holder and transmits the kinetic energy of the striker to the hammer bit. The striking part 115 is a feature that corresponds to the "striking part" according to this invention.

Thus, the rotating output of the motor output shaft 112 of the motor 111 is appropriately converted into linear motion via the motion converting part 113 at reduced speed and transmitted to the striking part 115. Then, an impact force is generated in the axial direction of the hammer bit 119 (the horizontal direction in FIG. 3) via the striking part 115. Although not shown, the motor 111 houses and holds an armature which rotates together with the motor output shaft 112, a stator which is fixed within a motor case, a commutator which is disposed on a lower portion of the motor, and a feeding brush (also referred to as a "carbon brush") which is disposed on the lower portion of the motor and serves to feed current to the motor in sliding contact with an outer circumferential surface of the commutator. The motor 111 is a feature that corresponds to the "motor" according to this invention.

Further, the motor 111 has a striking part cooling fan 120 and a motor cooling fan 130 which are activated when the motor output shaft 112 rotates. The striking part cooling fan 120 is connected to an upper part of the motor output shaft 112 and the motor cooling fan 130 is connected to a lower part of the motor output shaft 112. The striking part cooling fan 120 and the motor cooling fan 130 form component parts housed within the body 103, or typically cooling structures for cooling the motor 111 and the striking part 115. An axial fan or a centrifugal fan can be appropriately selected for use as the cooling fans 120, 130. In this case, the two cooling fans may be of the same type, or they may be of different types.

The striking part cooling fan 120 is housed within a cooling fan receptacle 121 disposed above the motor 111 (on the upper side as viewed in FIG. 3). The striking part cooling fan 120 is a feature that corresponds to the "striking part cooling fan" according to this invention. The cooling fan receptacle 121 communicates with a housing space 113*a* for the motion converting part 113 via a communication part 123 formed in a partition between the cooling fan receptacle 120 and the motion converting part 113. The housing space 113*a* further communicates with the outside via the first inlets 122 through a housing space 115*a* for the striking part 115 in the striking part housing 108. Further, the cooling fan receptacle 121 communicates with the outside via the first outlets 124. Thus, a cooling air passage for cooling air to flow at least through the housing space 115*a* and the housing space 113*a* when the striking part cooling fan 120 is activated is formed between the first inlets 122 and the first outlets 124. This cooling air passage which is formed within the body 103 and through which cooling air can flow to the striking part 115 is a feature that corresponds to the "second cooling air passage" according to this invention.

The motor cooling fan 130 is housed within a cooling fan receptacle 131 disposed below the motor housing 105 (on the lower side as viewed in FIG. 3). The motor cooling fan 130 is a feature that corresponds to the "motor cooling fan" according to this invention. The cooling fan receptacle 131 communicates with a housing space 111*a* for the motor 111 via a communication part 133 formed in a partition between the cooling fan receptacle 131 and the motor 111. The housing space 111*a* further communicates with the outside via the second inlets 132. Further, the cooling fan receptacle 131 communicates with the outside via the second outlets 134 formed in the bottom of the motor housing 105 or the bottom of the cooling fan receptacle 131. Thus, a cooling air passage for cooling air which flows at least through the housing space 111*a* when the motor cooling fan 130 is activated is formed between the second inlets 132 and the second outlets 134. This cooling air passage which is formed within the body 103 and through which cooling air can flow to the motor 111 is a feature that corresponds to the "first cooling air passage" according to this invention.

The cooling air passages for the striking part cooling fan 120 and the motor cooling fan 130 may be preferably formed by using a partition wall which is disposed within the body 103. Further, in order to enhance the hermeticity of the cooling air passages, preferably, the partition wall itself may be formed by an elastic element, or an elastic element may be mounted on the partition wall.

Flow of cooling air caused by activation of the striking part cooling fan 120 and the motor cooling fan 130 which are constructed as described above is specifically explained with reference to FIGS. 4 and 5. FIG. 4 schematically shows flow of cooling air in the electric hammer 101 of FIG. 3, and FIG. 5 schematically shows flow of cooling air in the electric hammer 101 of FIG. 2. In FIGS. 4 and 5, the cooling air flow produced by the striking part cooling fan 120 is shown by solid thick arrow, and the cooling air flow produced by the motor cooling fan 130 is shown by hollow arrow. Further, in FIG. 4, for the sake of convenience of explanation, cooling air to be discharged through the first outlets 124 is shown as being discharged toward the back wall of the housing, but actually, the first outlets 124 are formed in the side walls of the housing as shown in FIG. 1, and the cooling air is discharged laterally to the right and left as shown by arrow in FIG. 5 through the first outlets 124 fanned in the side walls of the housing.

As shown in FIGS. 4 and 5, when the striking part cooling fan 120 is activated by rotation of the motor output shaft 112 of the motor 111, flow of cooling air from the first inlets 122 toward the first outlets 124 is produced in the cooling air passage formed between the first inlets 122 and the first outlets 124. Specifically, by the sucking action of the activated striking part cooling fan 120, outside air is led firstly into the housing space 115*a* through the first inlets 122 and then into the housing space 113*a* and it further flows into the cooling fan receptacle 121 through the communication part 123. At this time, the striking part 115, the motion converting part 113 and their surrounding regions are cooled by the cooling air in sequence. In this case, this cooling structure can be designed to cool at least one of the crank mechanism and the gear speed reducing mechanism of the motion converting part 113. The cooling air led into the cooling fan receptacle 121 is pressurized by the striking part cooling fan 120 and then discharged to the outside through the first outlets 124. Thus, in this embodiment, the striking part cooling fan 120 is designed to cool at least the striking part 115.

When the motor cooling fan 130 is activated by rotation of the motor output shaft 112 of the motor 111, flow of cooling air from the second inlets 132 toward the second outlets 134 is produced in the cooling air passage formed between the second inlets 132 and the second outlets 134. Specifically, by the sucking action of the activated motor cooling fan 130, outside air is led first into the housing space 111*a* through the second inlets 132 and then into the cooling fan receptacle 131 through the communication part 133. At this time, the motor 111 and its surrounding regions are cooled by the cooling air. The cooling air led into the cooling fan receptacle 131 is pressurized by the motor cooling fan 130 and then discharged to the outside through the second outlets 134. Thus, in this embodiment, the motor cooling fan 130 is designed to cool the motor 111.

In the above-described cooling structure, the striking part cooling fan 120 for cooling the striking part 115 and the motion converting part 113 and the motor cooling fan 130 for cooling the motor 111 are designed to be independent of each other. Therefore, the striking part cooling fan 120 and the motor cooling fan 130 can be designed to have different specifications, for example, in kind (such as an axial fan and a centrifugal fan) or in flow rate, so that optimum setting for each of the cooling fans to cool the respective areas to be cooled can be made. As a result, increase of temperature of each of the areas to be cooled can be efficiently prevented.

Further, in the above-described cooling structure, by provision of the construction in which the second inlets 132 for the cooling air of the motor cooling fan 130 are formed in a back side of the tool body 103 (the motor housing 105), or specifically on the far side of the tool body 103 opposite to the hammer bit 119, dust which is generated during operation to be performed on the workpiece by the hammer bit 119 cannot be easily sucked in.

Further, in the above-described cooling structure, cooling air used for cooling the striking part 115 is not used for cooling the motor 111. Therefore, dust can be prevented from entering the feeding brush of the motor 111 and having an adverse effect such as a so-called carbon lock.

Further, in the above-described cooling structure, both of the striking part cooling fan 120 and the motor cooling fan 130 are disposed near the respective outlets or downstream of the respective cooling air passages, and the striking part 115 and the motor 111 are cooled by cooling air which is produced by induced cooling fans. Such an induced cooling fan is more efficient and advantageous than a forced cooling fan which is disposed upstream of a cooling air passage.

As for a cooling structure for cooling each component of the electric hammer, different embodiments from the above-described cooling structure can be applied. Second to fourth embodiments of the electric hammer having different cooling structures are now described.

(Second Embodiment)

An entire construction of an electric hammer 201 according to a second embodiment as a representative embodiment of the "power tool" of the invention is now described with reference to FIGS. 6 and 7. FIG. 6 shows a body of the electric hammer 201 of the second embodiment partly in section. FIG. 7 shows the electric hammer 201 of the second embodiment as viewed from the handgrip 109 side, The electric hammer 201 of the second embodiment has about the same overall construction as the electric hammer 101 of the first embodiment. Therefore, in FIGS. 6 and 7, components or elements in the second embodiment which are substantially identical to those shown in FIGS. 1 to 3 are given like numerals and are not described.

The electric hammer 201 shown in FIGS. 6 and 7 has a single cooling fan 220 which is activated by rotation of a motor output shaft 212 of a motor 211. The cooling fan 220 forms a cooling structure for cooling component elements housed within the body 103, or typically the motor 211 and the striking part 115. An axial fan or a centrifugal fan can be appropriately selected for use as the cooling fan 220. The motor 211 and the feeding brush 114 of the motor 211 are features that correspond to the "motor" and the "feeding brush", respectively, according to this invention.

The cooling fan 220 is housed within a cooling fan receptacle 221 disposed above the motor 211 (on the upper side as viewed in FIG. 6) in the motor housing 105. The cooling fan 220 is disposed between the motor 211 and the motion converting part 113 on the side of the motor 211 opposite to the feeding brush 114. The cooling fan 220 is a feature that corresponds to the "single cooling fan" according to this invention. The cooling fan receptacle 221 communicates with the housing space 113*a* and thus with the outside via a plurality of slit-like outlets 226 which are formed in the both side walls of the body 103 (the motion converting part housing 107). The outlets 226 are features that correspond to the "outlet which is formed lateral to the motion converting part" according to this invention. Further, the cooling fan receptacle 221 communicates with a housing space 211 a for the motor 211 via a communication part 224 formed in a partition between the cooling fan receptacle 221 and the motor 211. The housing space 211*a* communicates with the housing space 115*a* via a communication part 225, and the housing space 115*a* further communicates with the outside via a plurality of slit-like first inlets 222 which are formed in the both side walls of the striking part housing 108 lateral to or forward of the striking part 115. Further, a partition wall 227 is provided between the housing spaces 115*a* and 113*a* and serves to prevent cooling air from directly flowing between the housing spaces 115*a* and 113*a*. The housing space 211*a* communicates with the outside via a second inlets 223 formed in the bottom of the motor housing 105 (below the motor 211). The first inlets 222 and the second inlets 223 are features that correspond to the "inlet which is formed below the motor" according to this invention.

In this manner, a cooling air passage for cooling air to flow through the housing spaces 115*a* and 113*a* when the cooling fan 220 is activated is formed between the first inlets 222 and the outlets 226, and a cooling air passage for cooling air to flow through the housing spaces 211 a and 113*a* when the cooling fan 220 is activated is formed between the second inlets 223 and the outlets 226. Specifically, the cooling fan 220 serves to produce the flows of cooling air for both of the cooling air passages. The cooling air passage formed between the first inlets 222 and the outlets 226 and the cooling air passage formed between the second inlets 223 and the outlets 226 are features that correspond to the "second cooling air passage" and the "first cooling air passage", respectively, according to this invention.

The cooling air passage which communicates with the first inlets 222 and the cooling air passage which communicates with the second inlets 223 may be preferably formed by using a partition wall which is disposed within the body 103. Further, in order to enhance the hermeticity of the cooling air passages, preferably, the partition wall itself may be formed by an elastic element, or an elastic element may be mounted on the partition wall.

Flow of cooling air caused by activation of the cooling fan 220 which is constructed as described above is specifically explained with reference to FIGS. 8 and 9. FIG. 8 schematically shows flow of cooling air in the electric hammer 201 of FIG. 6, and FIG. 9 schematically shows flow of cooling air in the electric hammer 201 of FIG. 7. In FIGS. 8 and 9, as for the cooling air flow produced by the cooling fan 220, the flow of cooling air through the first inlets 222 is shown by solid thick arrow, and the flow of cooling air through the second inlets 223 is shown by hollow arrow.

As shown in FIGS. 8 and 9, when the cooling fan 220 is activated by rotation of the motor output shaft 212 of the motor 211, flow of cooling air from the first inlets 222 toward the outlets 226 is produced in the cooling air passage formed between the first inlets 222 and the outlets 226. Specifically, by the sucking action of the activated cooling fan 220, outside air is led into the housing space 115*a* through the first inlets 222. At this time, the striking part 115 and its surrounding regions are cooled by the cooling air. After flowing through the housing space 115*a*, the cooling air is prevented from flowing directly into the housing space 113*a* by the partition wall 227 and flows into the housing space 211 a for the motor 211 through the communication part 225.

By the sucking action of the activated cooling fan 220, outside air is also led into the motor housing space 211*a* through the second inlets 223 and merged with the cooling air led into the motor housing space 211*a* from the housing space 115*a*. At this time, the motor 211 and its surrounding regions are cooled by these cooling air flows. Thereafter, the two cooling air flows merged in the housing space 211 a are led into the cooling fan receptacle 121 through the communication part 224 and pressurized and then led into the housing space 113*a*. Thereafter, the cooling air led into the housing space 113*a* is discharged to the outside through the same outlets 226 which are used for both of the two cooling air passages. In this ease, it may be constructed such that the cooling air used for cooling the striking part 115 and the cooling air used for cooling the motor 211 may be merged to cool at least one of the crank mechanism and the gear speed reducing mechanism of the motion converting part 113, or to cool other parts. The degree of increase of temperature of the motion converting part 113 is lower than that of the motor 211 and the striking part 115, so that a desired cooling effect can be obtained even by the cooling air used for cooling the striking part 115 and the motor 211.

By provision of the above-described cooling structure, the motor 211, the striking part 115 and the motion converting part 113 can be rationally cooled only by the single cooling fan 220. Further, the cost increase can be avoided by using an existing cooling fan. Thus, an efficient cooling structure can be realized. Further, the cooling air which have flown through the two cooling air passages can be merged to cool other components of the power tool.

Further, in the above-described cooling structure, the cooling fan 220 is disposed above the motor 211 on the side of the motor 211 opposite to the feeding brush 114 so as to be located away from the feeding brush 114. This structure is effective in preventing entry of dust into the feeding brush of the motor 111 which may have an adverse effect such as a so-called carbon lock.

Further, in the above-described cooling structure, the cooling fan 220 is designed as a induced cooling fan which is disposed near the outlets or downstream of the cooling air passages. Such an induced cooling fan is more efficient and advantageous than a forced cooling fan which is disposed upstream of a cooling air passage.

(Third Embodiment)

An entire construction of an electric hammer 301 according to a third embodiment as a representative embodiment of the "power tool" of the invention is now described with reference to FIG. 10. FIG, 10 shows a body of the electric hammer 301 of the third embodiment partly in section. The electric hammer 301 of the third embodiment has about the same overall construction as the electric hammer 101 of the first embodiment. Therefore, in FIG. 10, components or elements in the third embodiment which are substantially identical to those shown in FIGS. 1 to 3 are given like numerals and are not described.

The electric hammer 301 shown in FIG. 10 has a cooling fan 320 which is activated by rotation of a motor output shaft 312 of a motor 311. The cooling fan 320 forms a cooling structure for cooling component elements housed within the body 103, or typically the motor 311 and the striking part 115. An axial fan or a centrifugal fan can be appropriately selected for use as the cooling fan 320. The motor 311 is a feature that corresponds to the "motor" according to this invention.

The cooling fan 320 is housed within a cooling fan receptacle 321 disposed below the motor 311 (on the lower side as viewed in FIG. 10) in the motor housing 105. The cooling fan 320 is a feature that corresponds to the "single cooling fan" according to this invention. The cooling fan receptacle 321 communicates with the outside via an outlet 329 which is formed in a bottom of the motor housing 105 or a bottom of the cooling fan receptacle 321. The outlet 329 is a feature that corresponds to the "single outlet which communicates with both of the first and second cooling air passages" according to this invention. Further, the cooling fan receptacle 321 communicates with the housing space 115*a* via a communication part 328 formed below the motor and a communication part 327 lateral to the motor.

A partition wall 325 is provided in the housing space 115*a* and partitions the housing space 115*a* in the axial direction of the hammer bit 119. The housing space 115*a* is partitioned into upper and lower sections 325*a*, 325*b* by the partition wall 325. The sections 325*a*, 325*b* communicate with each other via a plurality of communication holes 326 which are formed in the partition wall 325 and spaced apart from each other in the axial direction of the hammer bit 119. The partition wall 325 is a partition wall that partitions the housing space 115*a* in the axial direction of the hammer bit 119 and corresponds to the "partition wall" according to this invention. Further, the communication holes 326 are communication parts formed in the partition wall 325 and spaced apart from each other in the axial direction of the hammer bit 119 and correspond to the "second communication parts" according to this invention. The lower section 325*b* communicates with the communication holes 326, and the upper section 325*a* communicates with the housing space 113*a* via a communication part 324. The housing space 113*a* further communicates with the outside via a first inlet 322 formed in the back wall of the housing of the body 103 (the tool rear surface). The communication part 324 is a communication part for communication between the first inlet 322 and the housing space 115*a* and corresponds to the "first communication part" according to this invention. Further, the cooling fan receptacle 321 communicates with the outside via a second inlet 323 which is formed in the back wall of the housing of the body 103, through the communication part 328 and the housing space 311*a* for the motor 311. The first inlet 322 and the second inlet 323 are features that correspond to the "inlet which communicates with the second cooling air passage" and the "inlet which communicates with the first cooling air passage", respectively, according to this invention.

Thus, a cooling air passage for cooling air which flows through the housing space 115*a* and the housing space 113*a* when the cooling fan 320 is activated is formed between the first inlet 322 and the outlet 329. Further, a cooling air passage for cooling air which flows through the housing space 31 la when the cooling fan 320 is activated is formed between the second inlet 323 and the outlet 329. Specifically, the cooling fan 320 serves to create the flows of the cooling air for both of the two cooling air passages. The first inlet 322 and the second inlet 323 are both formed in the back wall of the housing of the body 103, and they may be formed either as separate inlets spaced apart from each other or as one inlet. The cooling air passage which is formed between the first inlet 322 and the outlet 329 and the cooling air passage which is formed between the second inlet 323 and the outlet 329 are features that correspond to the "second cooling air passage" and the "first cooling air passage", respectively, according to this invention.

The cooling air passages for communication with the first inlets 322 and the cooling air passage for communication with the second inlets 323 may be preferably formed by using a partition wall which is disposed within the body 103. Further, in order to enhance the hermeticity of the cooling air passages, preferably, the partition wall itself may be formed by an elastic element, or an elastic element may be mounted on the partition wall.

Flow of cooling air caused by activation of the cooling fan 320 which is constructed as described above is specifically explained with reference to FIG. 11. FIG. 11 schematically shows flow of cooling air in the electric hammer 301 of FIG. 10. In FIG. 11, as for the cooling air flow produced by the cooling fan 320, the flow of cooling air through the first inlet 322 is shown by solid thick arrow, and the flow of cooling air through the second inlet 323 is shown by hollow arrow.

In the electric hammer 301 shown in FIG. 11, When the cooling fan 320 is activated by rotation of the motor output shaft 312 of the motor 311, flow of cooling air from the first inlet 322 toward the outlet 329 is produced in the cooling air passage formed between the first inlet 322 and the outlet 329. Specifically, by the sucking action of the activated cooling fan 320, outside air is led into the housing space 113*a* through the first inlet 322 and then flows into the section 325*a* of the housing space 115*a* through the communication part 324. In the section 325*a*, the cooling air passage for air flow into the section 325*b* is throttled by the communication holes 326. Therefore, the cooling air is scattered almost evenly over a wide range in the axial direction of the hammer bit 119, so that the striking part 115 is almost evenly cooled in its entirety. Thereafter, the cooling air is led from the section 325*b* into the housing space 311 a for the motor 311 through the communication part 327.

Further, when the cooling fan 320 is activated by rotation of the motor output shaft 312 of the motor 311, flow of cooling air from the second inlet 323 toward the outlet 329 is produced in the cooling air passage formed between the second inlet 323 and the outlet 329. Specifically, by the sucking action of the activated cooling fan 320, outside air is led into the housing space 311 a for the motor 311 through the second inlet 323. At this time, the motor 311 and its surrounding regions are cooled by the cooling air. The cooling air used for cooling the motor 311 is merged with the cooling air flowing into the housing 311*a* through the communication part 327. Thereafter, the two cooling air flows merged in the housing 311*a* are led into the cooling fan receptacle 321 through the communication part 328 and pressurized and then discharged to the outside through the outlet 329.

By provision of the above-described cooling structure, the motor 311, the striking part 115 and the motion converting part 113 can be rationally cooled by the single cooling fan 320. Further, the cost increase can be avoided by using an existing cooling fan. Thus, an efficient cooling structure can be realized. Further, by partitioning the housing space 115 by the partition wall 235 having the communication holes 326, the striking part 115 can be almost evenly cooled in its entirety.

Further, in the above-described cooling structure, the cooling fan 220 is designed as a induced cooling fan which is disposed near the outlet or downstream of the cooling air passages. Such an induced cooling fan is more efficient and advantageous than a forced cooling fan which is disposed upstream of a cooling air passage.

(Fourth Embodiment)

An entire construction of an electric hammer 401 according to a fourth embodiment as a representative embodiment of the "power tool" of the invention is now described with reference to FIG. 12. FIG. 12 shows a body of the electric hammer 401 of the fourth embodiment partly in section. The cooling structure of the electric hammer 401 of the fourth embodiment is only different in the cooling air passages from that of the electric hammer 301 of the third embodiment. Therefore, in FIG. 12, components or elements in the fourth embodiment which are substantially identical to those shown in FIG. 3 are given like numerals and are not described.

The electric hammer 401 shown in FIG. 12 does not have any element such as the partition wall 325 of the electric hammer 301. In the electric hammer 401, the first inlet 322 for communication with the outside communicates with the housing space 113*a*, the communication part 327 and the housing space 311 a for the motor 311 in this order.

Flow of cooling air caused by activation of the cooling fan 320 in the electric hammer 401 constructed as described above is specifically explained with reference to FIG. 13. FIG. 13 schematically shows flow of cooling air in the electric hammer 401 of FIG. 12.

In the electric hammer 401 shown in FIG. 13, when the cooling fan 320 is activated by rotation of the motor output shaft 312 of the motor 311, flow of cooling air from the first inlet 322 toward the outlet 329 is produced in the cooling air passage (second cooling air passage) formed between the first inlet 322 and the outlet 329. Specifically, by the sucking action of the activated cooling fan 320, outside air is led into the housing space 113*a* through the first inlet 322 and cools the motion converting part 113. Thereafter, the cooling air flows into the housing space 113*a* for the motor 311 through the communication part 327. At this time, part of the cooling air flowing through the housing space 113*a* flows into the housing space 115*a* through a region between the housing space 113*a* and the housing space 115*a* and directly cools the striking part 115. Or it indirectly cools the striking part 115 by cooling the motion converting part 113 which is raised in temperature by thermal conduction from the striking part 115. Therefore, the cooling air passage between the first inlet 322 and the outlet 329 is defined as a cooling air passage (the "second cooling air passage" in this invention) through which cooling air can be led to the striking part 115. Further, cooling air led into the housing space 113*a* through the communication part 327 is merged with cooling air led into the housing space 113*a* through the second inlet 323 and used for cooling the motor 311. Thereafter, the merged cooling air is led into the cooling fan receptacle 321 through the communication part 328 and pressurized and then discharged to the outside through the outlet 329.

By provision of the above-described cooling structure, the motor 311, the motion converting part 113 and the striking part 115 can be rationally cooled only by the single cooling fan 320. Further, the cost increase can be avoided by using an existing cooling fan. Thus, an efficient cooling structure can be realized.

(Other Embodiments)

The invention is not limited to the above embodiments, but rather, may be added to, changed, replaced with alternatives or otherwise modified. For example, the following provisions can be made in application of these embodiments.

In the above-described first embodiment, it is essential for the electric hammer 101 to be constructed such that the striking part cooling fan 120 is disposed above the motor 111 and the motor cooling fan 130 is disposed below the motor 111. Therefore, arrangement of the inlets and the outlets for the striking part cooling fan 120 and arrangement of the inlets and the outlets for the motor cooling fan 130 can be appropriately changed according to design specifications.

Further, in the above-described second embodiment, it is essential for the electric hammer 201 to be constructed such that the single cooling fan 220 for the motor and the striking part is disposed on the side of the motor 211 opposite to the feeding brush 114. Therefore, arrangement of the inlets and the outlets for the single cooling fan 220 can be appropriately changed according to design specifications.

Further, in the above-described embodiments, the electric hammers are described as a representative example of the power tool. However, the invention can also be applied to a hammer drill in which a tool bit such as the hammer bit 119 performs the striking movement and rotation.

Further, in the invention, in view of the above-described embodiments and various modifications, the following features can be provided.

Specifically, in the invention, the following construction is conceivable:

"The power tool as defined in claim 1, wherein the motor cooling fan and the striking part cooling fan are designed to have different fan specifications."

The fans having "different fan specifications" refer to the fans different in kind or in flow rate. With this construction, optimum setting for each of the cooling fans to cool the respective areas to be cooled can be made.

Further, in the invention, the following construction is conceivable:

"A power tool, in which an elongate tool bit is linearly driven to perform a predetermined operation, comprising:

a tool body, a motor that is housed within the tool body and disposed such that an extension of a motor output shaft extends transversely to an axis of the tool bit, a striking part that is housed within a front region of the tool body and strikes the tool bit, a motion converting part that is disposed above the motor and converts an output of rotating a motor output shaft when the motor is driven, into an output of striking the tool bit by the striking part, a first cooling air passage that is provided within the tool body and through which cooling air can be led to the motor, a second cooling air passage that is provided within the tool body and through which cooling air can be led to the striking part, and one or more cooling fans that are disposed above or below the motor and activated to supply cooling air to the first and second cooling air passages when the motor is driven, wherein the one or more cooling fans are designed as an induced cooling fan which is disposed downstream of the first and second cooling air passages in order to supply cooling air to the first and second cooling air passages by sucking action of the cooling fans."

With this construction, a more efficient cooling structure can be obtained than a forced cooling fan.

Further, in the invention, the following construction is conceivable:

"A power tool, in which an elongate tool bit is linearly driven to perform a predetermined operation, comprising:

a tool body, a motor that is housed within the tool body and disposed such that an extension of a motor output shaft extends transversely to an axis of the tool bit, a striking part that is housed within a front region of the tool body and strikes the tool bit, a motion converting part that is disposed above the motor and converts an output of rotating a motor output shaft when the motor is driven, into an output of striking the tool bit by the striking part, a first cooling air passage that is provided within the tool body and through which cooling air can be led to the motor, a second cooling air passage that is provided within the tool body and through which cooling air can be led to the striking part, and one or more cooling fans that are disposed above or below the motor and activated to supply cooling air to the first and second cooling air passages when the motor is driven, wherein the first and second cooling air passages are hermetically formed by an elastic partition wall which is formed within the tool body."

The "elastic partition wall" includes a partition wall which itself is formed by an elastic element, and or a partition wall on which an elastic element is mounted. In this manner, the hermeticity of the cooling air passages can be enhanced.

DESCRIPTION OF NUMERALS

Figure 1:
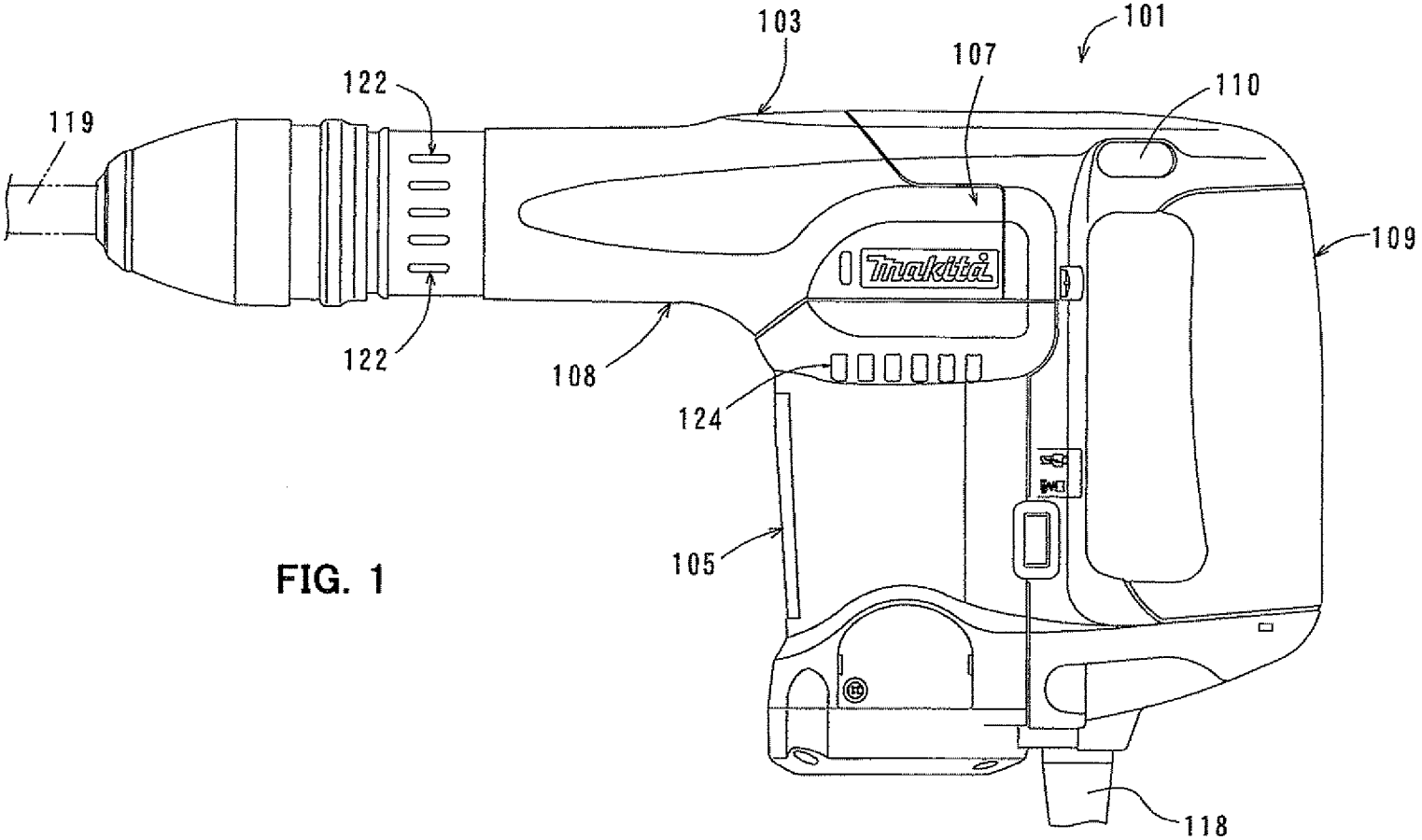
FIG. 1 is a side view showing an entire electric hammer 101 according to a first embodiment of the invention.
Figure 2:
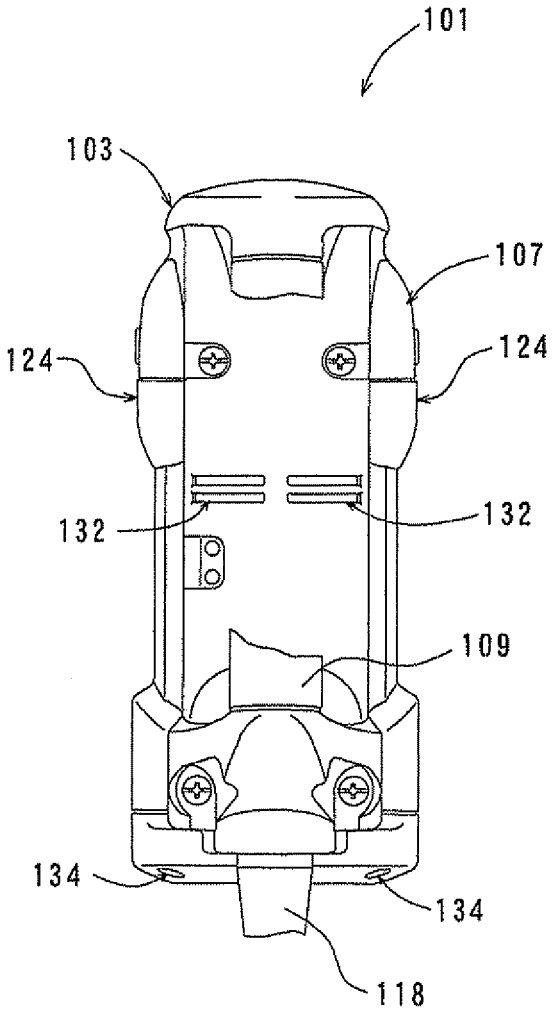
FIG. 2 shows the electric hammer 101 of FIG. 1 as viewed from a handgrip 109 side.
Figure 3:
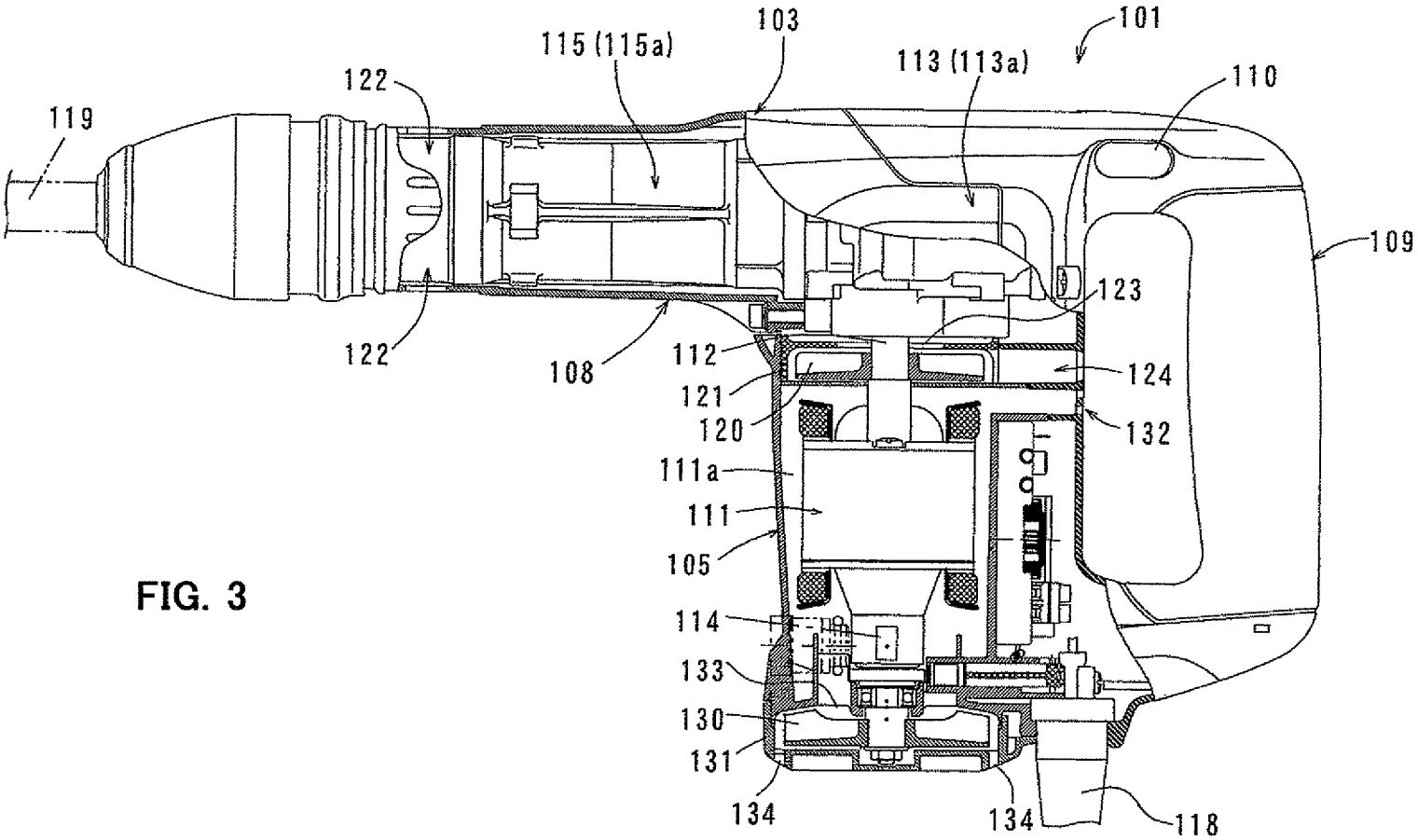
FIG. 3 shows a body 103 in the side view of the electric hammer 101 of FIG. 1 partly in section.
Figure 4:
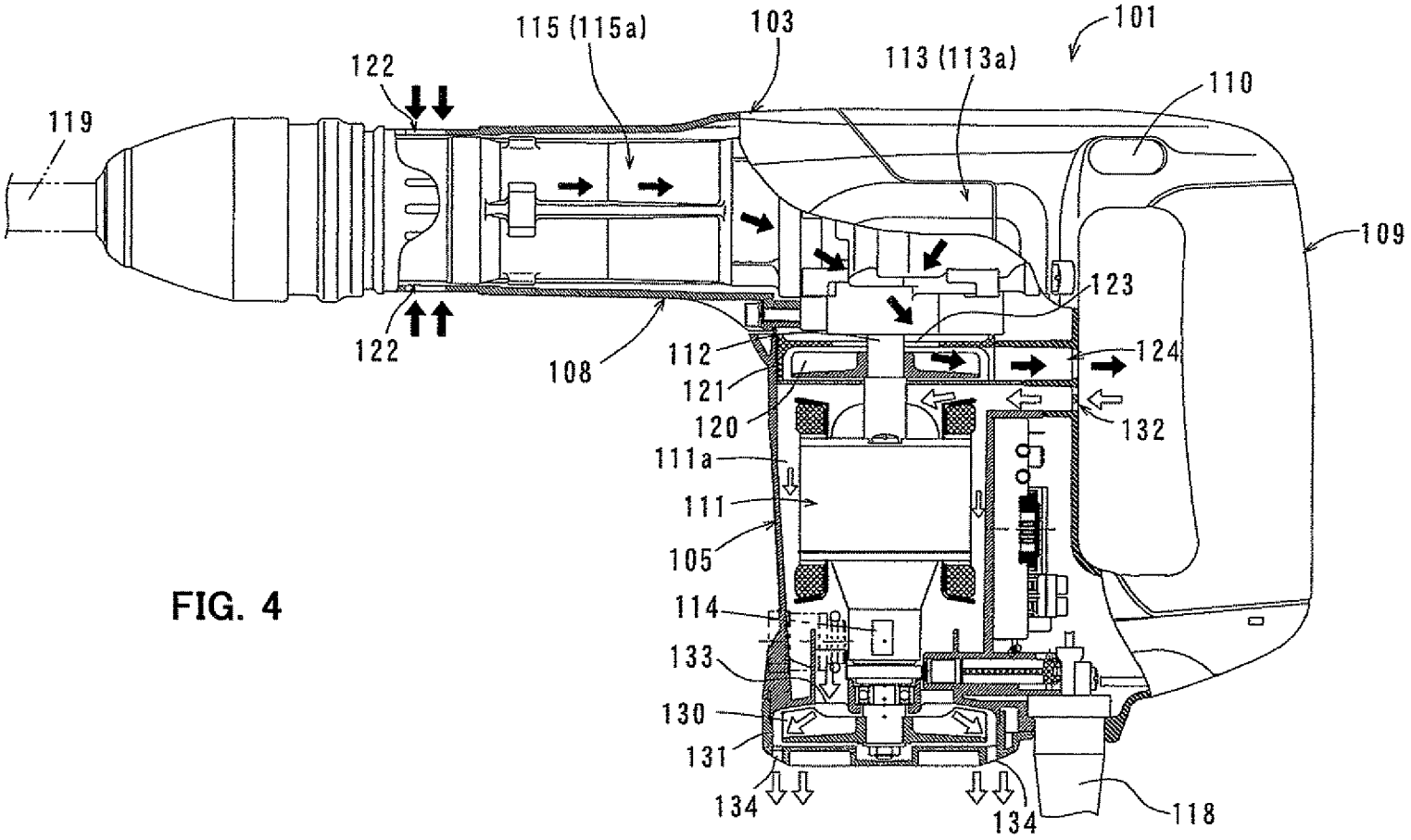
FIG. 4 schematically shows flow of cooling air in the electric hammer 101 of FIG. 3.
Figure 5:
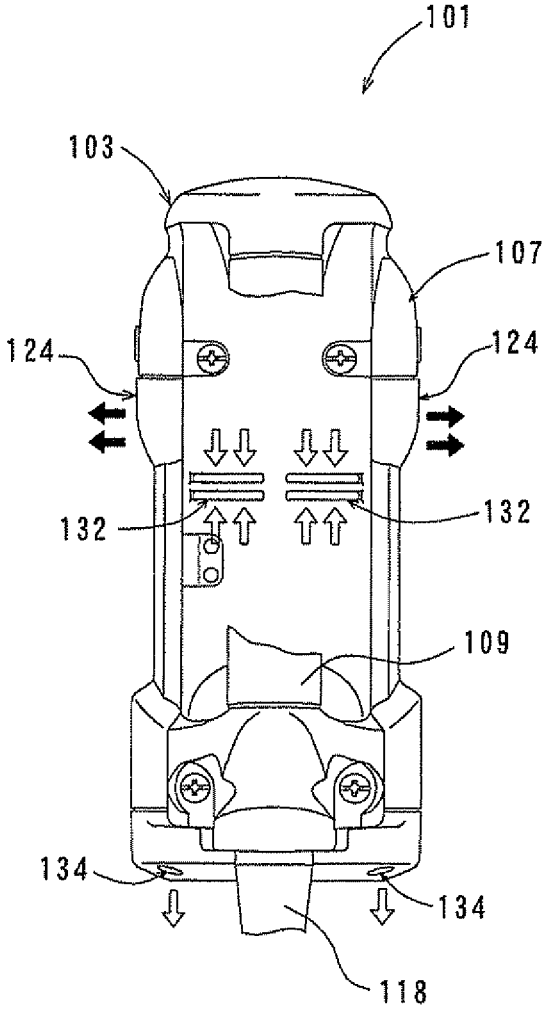
FIG. 5 schematically shows flow of cooling air in the electric hammer 101 of FIG. 2.
Figure 6:
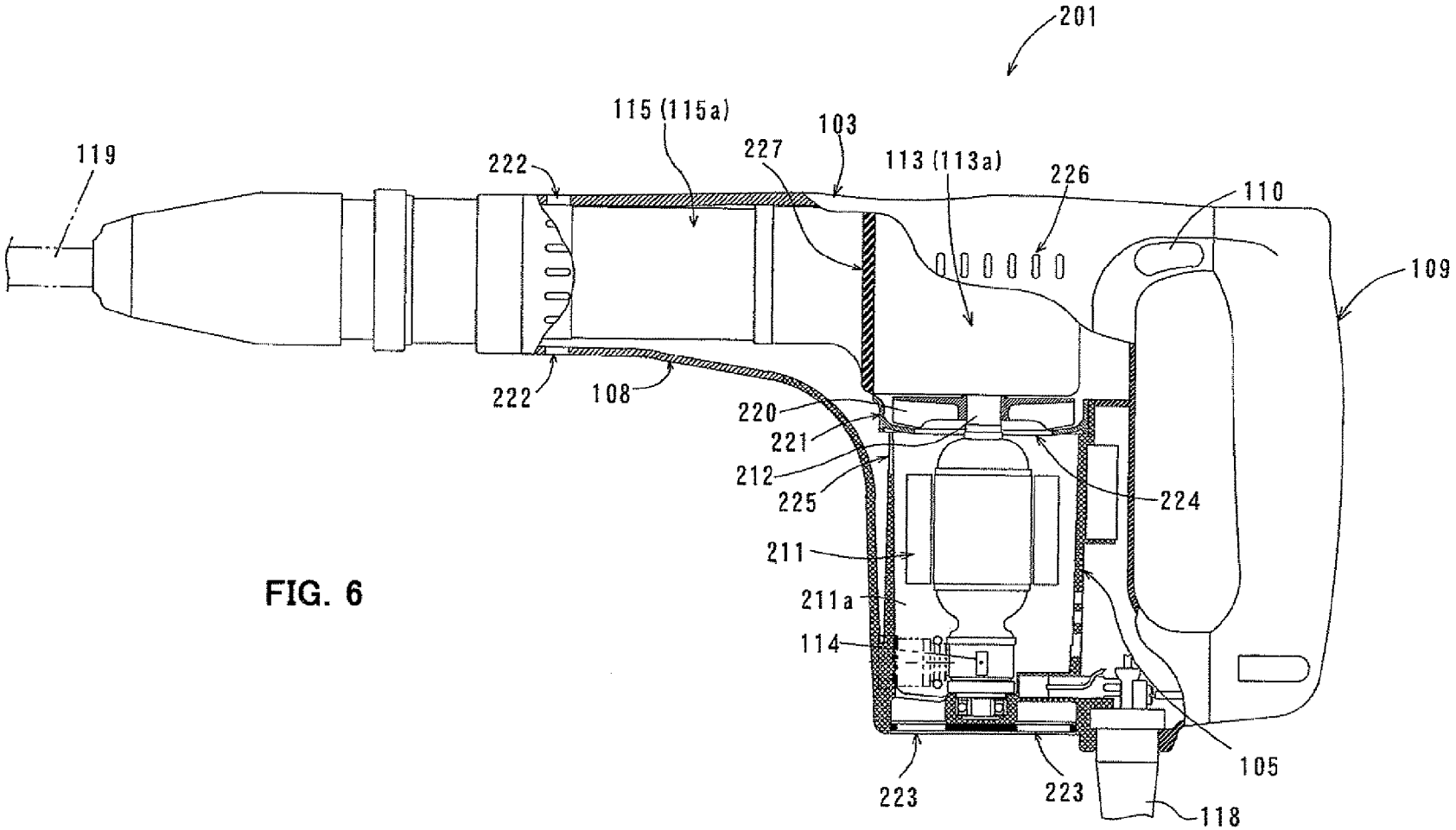
FIG. 6 shows a body of an electric hammer 201 of a second embodiment partly in section.
Figure 7:
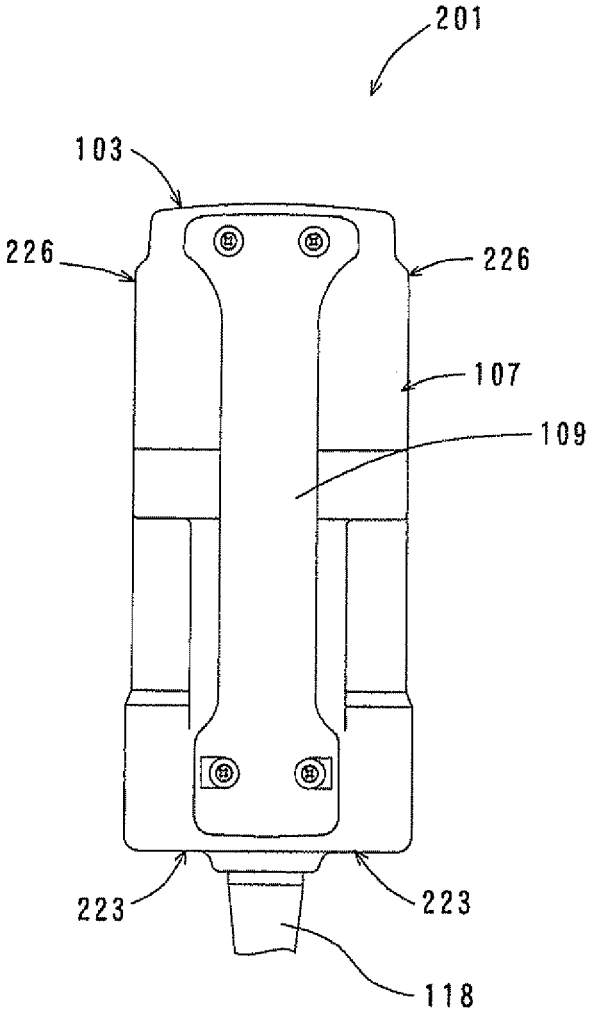
FIG. 7 shows the electric hammer 201 of the second embodiment as viewed from the handgrip 109 side.
Figure 8:
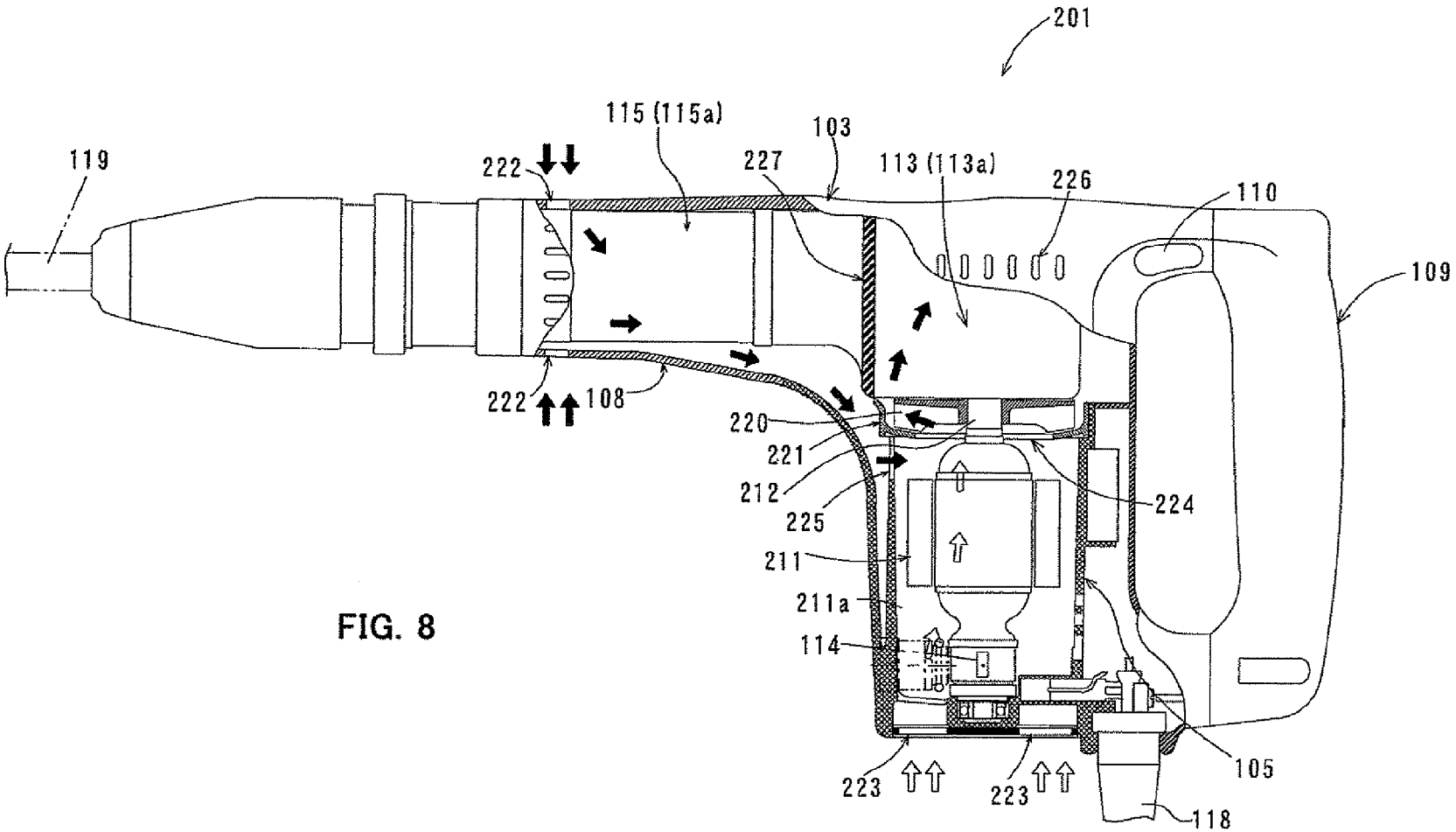
FIG. 8 schematically shows flow of cooling air in the electric hammer 201 of FIG. 6.
Figure 9:
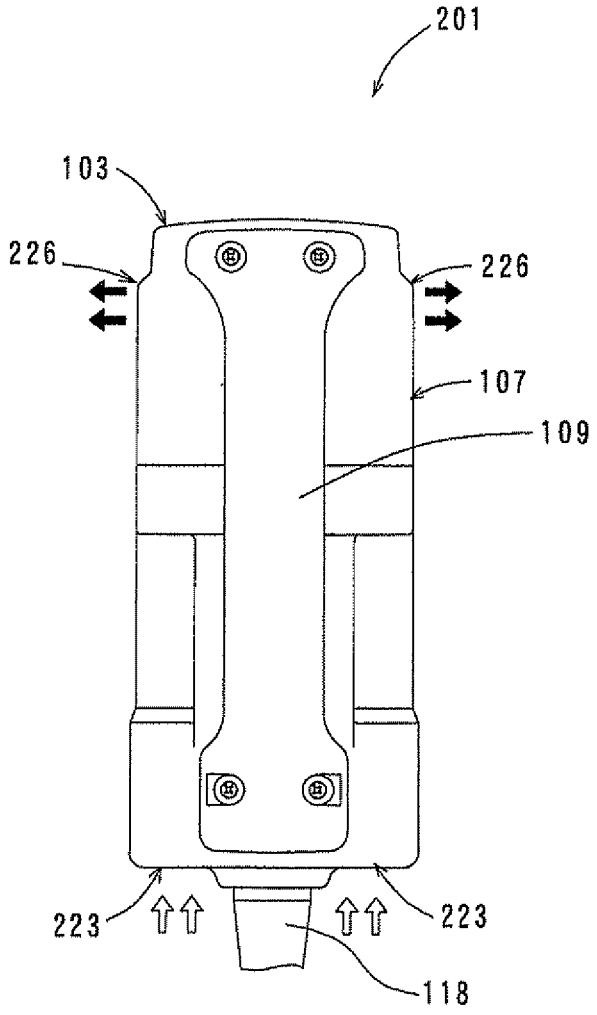
FIG. 9 schematically shows flow of cooling air in the electric hammer 201 of FIG. 7.
Figure 10:
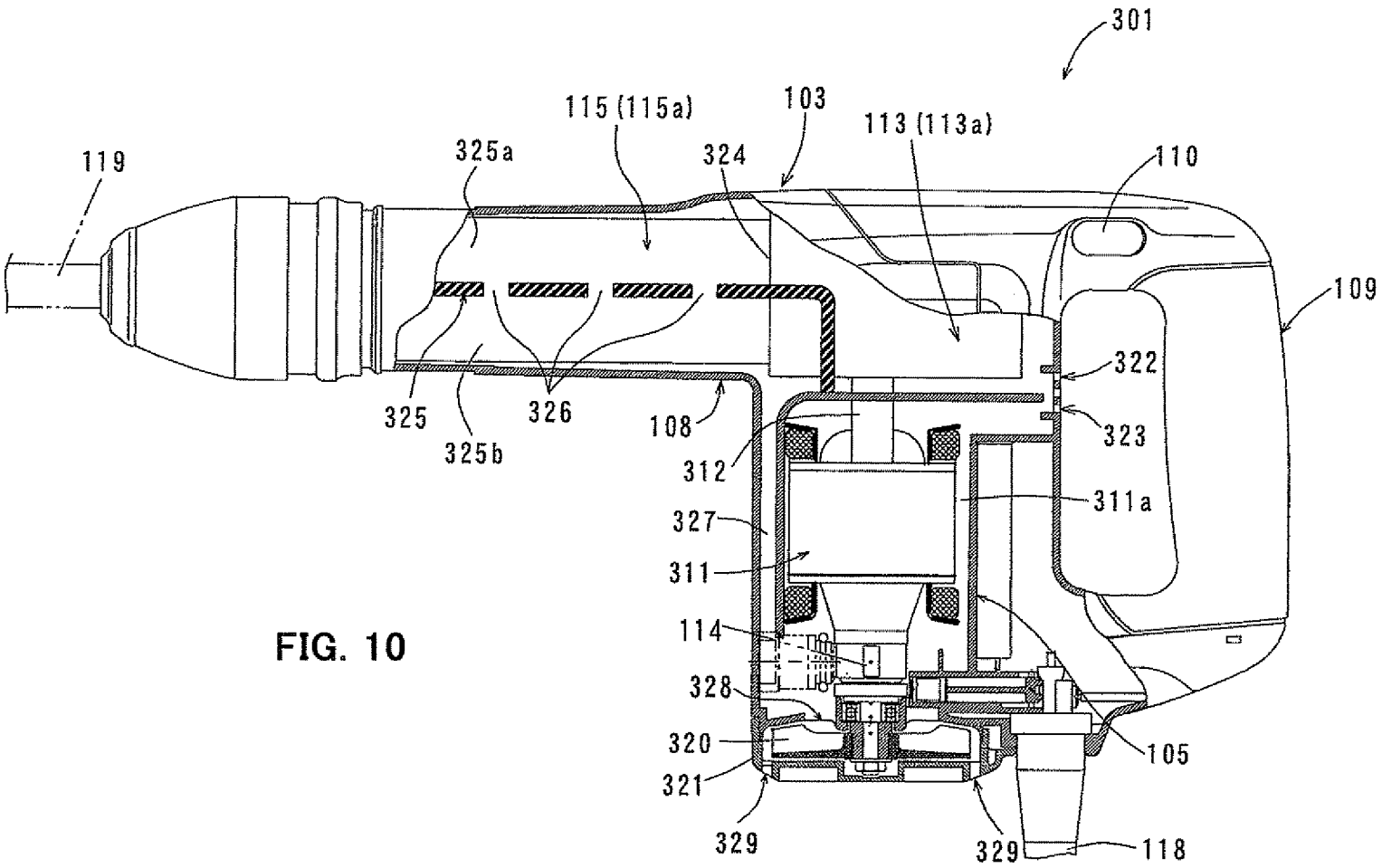
FIG. 10 shows a body of an electric hammer 301 of a third embodiment partly in section.
Figure 11:
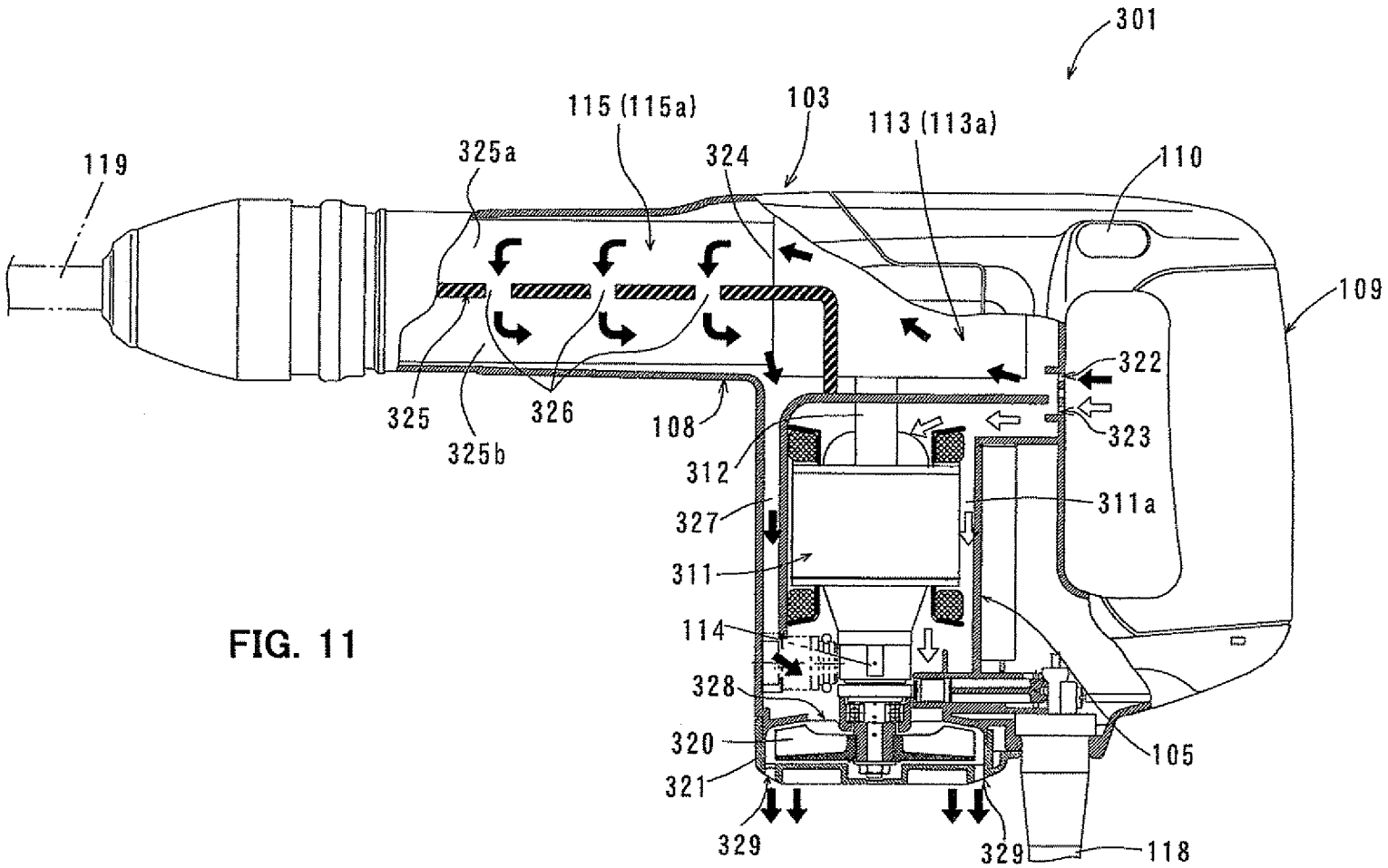
FIG. 11 schematically shows flow of cooling air in the electric hammer 301 of FIG. 10.
Figure 12:
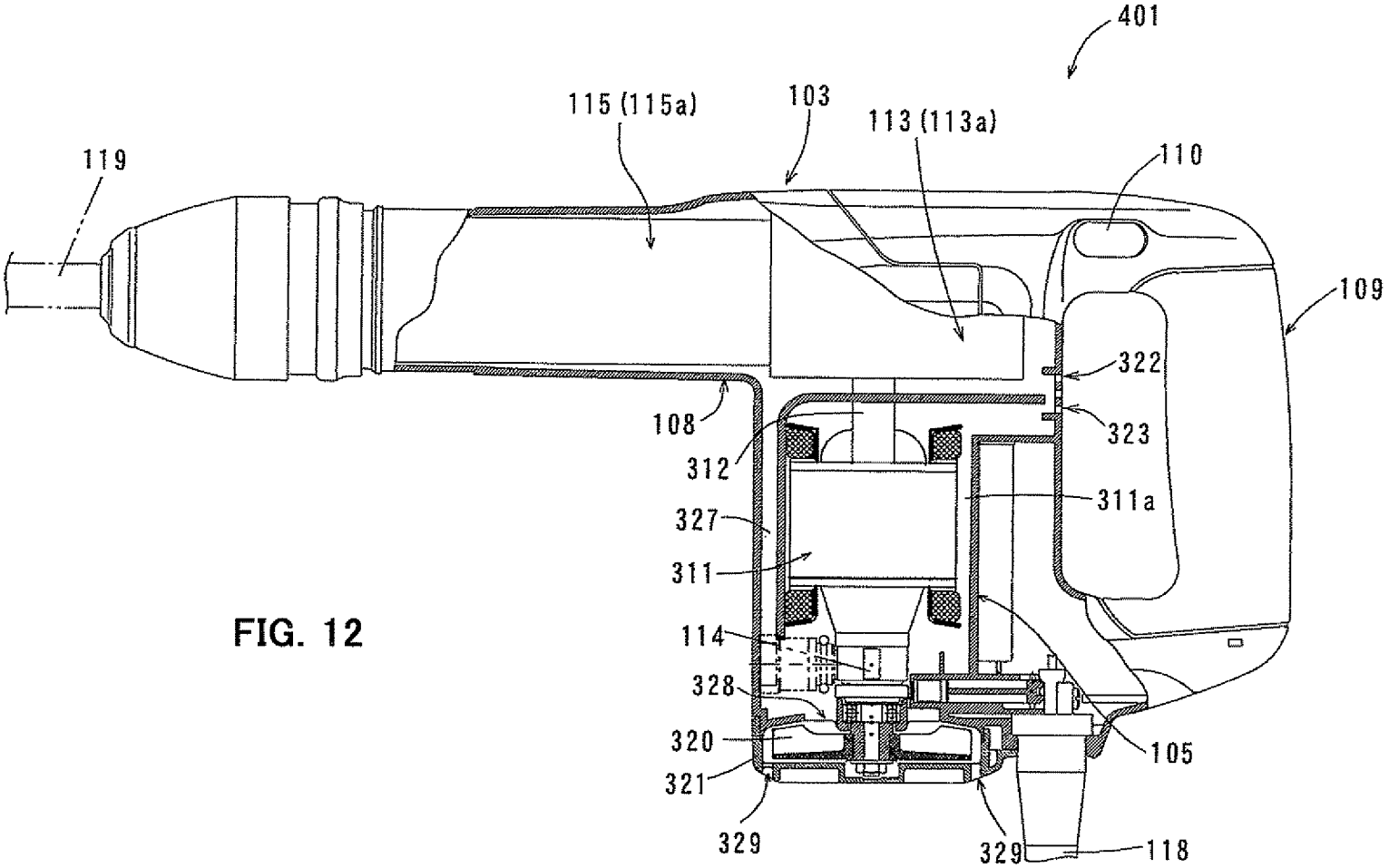
FIG. 12 shows a body of an electric hammer 401 of a fourth embodiment partly in section.
Figure 13:
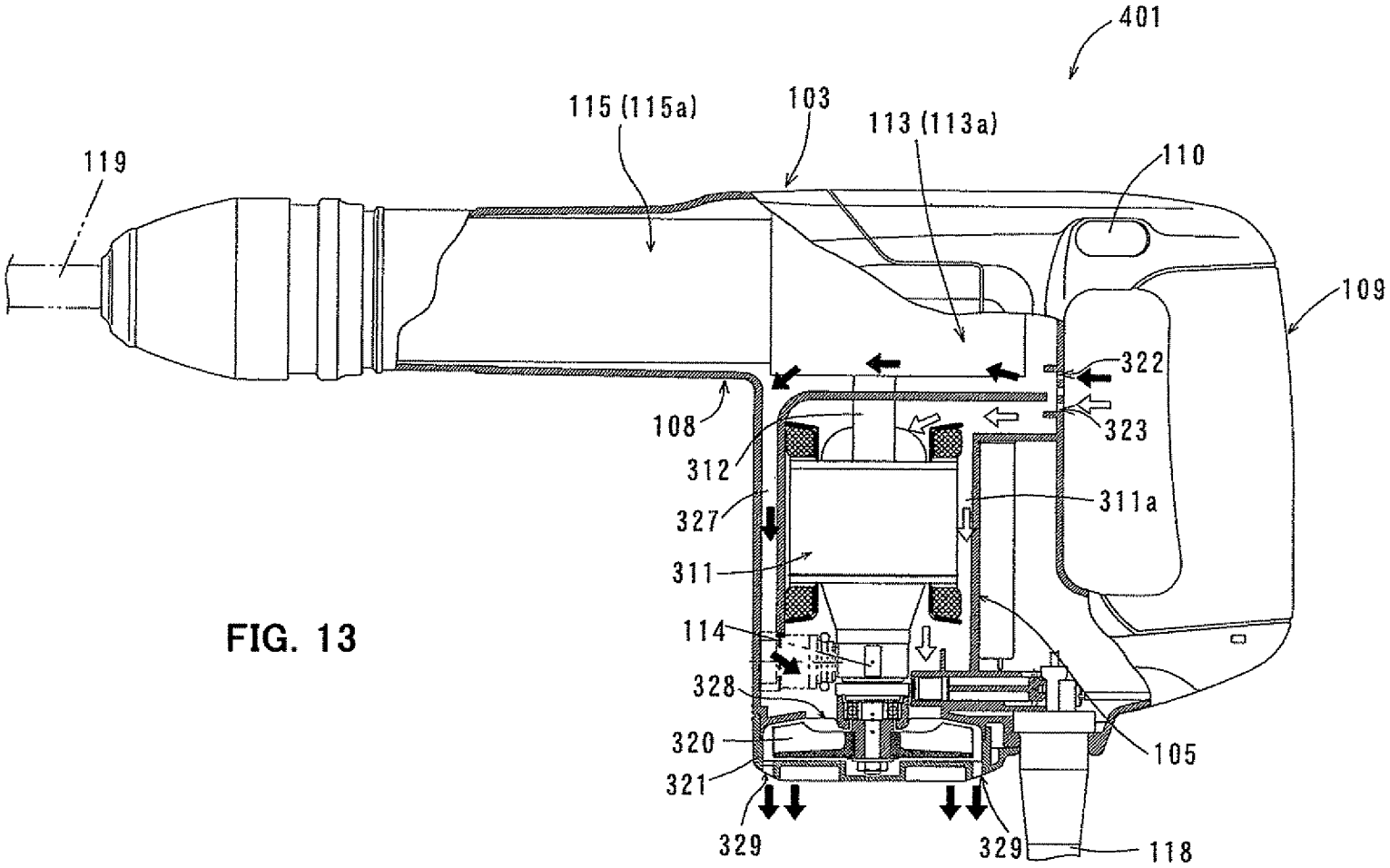
FIG. 13 schematically shows flow of cooling air in the electric hammer 401 of FIG. 12.

101, 201, 302, 401 electric hammer (power tool)
103 body (tool body)
105 motor housing
107 motion converting part housing
108 striking part housing
109 handgrip
110 operating member
111, 211, 311 motor
111*a*, 211*a*, 311*a* motor housing space
112, 212, 312 motor output shaft
113 motion converting part
113*a* housing space for motion converting part
114 feeding brush
115 striking part
115*a* housing space for striking part
118 AC cord
119 hammer bit (tool bit)
120 striking part cooling fan
121, 131, 221, 321 cooling fan receptacle
122 first inlet
123, 133 communication part
124 first outlet
130 motor cooling fan
132 second inlet
134 second outlet
222 first inlet
223 second inlet
224, 225 communication part
226 outlet
227 partition wall
322 first inlet
323 second inlet
324, 327, 328 communication part
325 partition wall
325*a*, 325*b* section
326 communication hole
329 outlet

The invention claimed is:

1. A power tool, in which a predetermined elongate tool bit is linearly driven to perform a predetermined operation, comprising:

a tool body, a motor that is housed within the tool body and disposed such that an extension of a motor output shaft extends transversely to an axis of the tool bit, a striking part that is housed within a front region of the tool body and strikes the tool bit, a motion converting part that is disposed above the motor and converts an output of rotating a motor output shaft when the motor is driven, into an output of striking the tool bit by the striking part, a first cooling air passage that is provided within the tool body and through which cooling air can be led to the motor, a second cooling air passage that is provided within the tool body and through which cooling air can be led to the striking part, a motor cooling fan that is disposed below the motor and activated to supply cooling air to the first cooling air passage when the motor is driven, and a striking part cooling fan that is disposed between the motor and the motion converting part and activated to supply cooling air to the second cooling air passage when the motor is driven, wherein the first cooling air passage and the second cooling air passage are separated by a partition wall which is disposed within the tool body, the partition wall being disposed in an area formed between the motor and the motion converting part, the first cooling air passage communicates with a second inlet and a second outlet, and the second cooling air passage communicates with a first inlet which is separately arranged from the second inlet and a first outlet which is separately arranged from the second outlet, and the second outlet is disposed at a motor side with respect to the partition wall, and the first outlet is disposed at a motion converting part side with respect to the partition wall.

2. The power tool as defined in claim 1, wherein the first cooling air passage communicates with the second inlet which is formed above the motor in the tool body and communicates with the second outlet which is formed below the motor in the tool body.

3. The power tool as defined in claim 2, wherein the second inlet is formed in a back side of the tool body on a side opposite to the tool bit.

4. The power tool as defined in claim 2, wherein the second cooling air passage communicates with the first inlet which is formed lateral to or forward of the striking part in the tool body and communicates with the first outlet which is formed lateral to the motion converting part in the tool body.

5. The power tool as defined in claim 1, wherein the second cooling air passage communicates with the first inlet which is formed lateral to or forward of the striking part in the tool body and communicates with the first outlet which is formed lateral to the motion converting part in the tool body.

6. A power tool, in which a predetermined elongate tool bit is linearly driven to perform a predetermined operation, comprising:

a tool body, a motor that is housed within the tool body and disposed such that an extension of a motor output shaft extends transversely to an axis of the tool bit, a striking part that is housed within a front region of the tool body and strikes the tool bit, a motion converting part that is disposed above the motor and converts an output of rotating a motor output shaft when the motor is driven, into an output of striking the tool bit by the striking part, a first cooling air passage that is provided within the tool body and through which cooling air can be led to the motor, a second cooling air passage that is provided within the tool body and through which cooling air can be led to the striking part, a single cooling fan that is disposed below the motor and activated to supply cooling air to both of the first and second cooling air passages when the motor is driven, and an inlet that communicates with the first cooling air passage and an inlet that communicates with the second cooling air passage, the inlets being formed in a back side of the tool body on a side opposite to the tool bit in the tool body, a single outlet that is disposed below the motor in the tool body and communicates with both of the first and second cooling air passages, a first communication part that communicates with a housing space for the striking part and the inlet which communicates with the second cooling air passage, a partition wall that partitions the housing space for the striking part in the tool body in the axial direction of the tool bit, and a plurality of second communication parts that are formed in the partition wall and spaced apart from each other in the axial direction of the tool bit.

* * * * *